US006807924B1

(12) United States Patent
Christiansen

(10) Patent No.: US 6,807,924 B1
(45) Date of Patent: Oct. 26, 2004

(54) ANTI-FOULING FLAG AND WINDSOCK DISPLAY ASSEMBLY

(76) Inventor: Craig S. Christiansen, 612 S. Lawler St., Mitchell, SD (US) 57301

( * ) Notice: Subject to any disclaimer, the term of this patent is extended or adjusted under 35 U.S.C. 154(b) by 0 days.

(21) Appl. No.: 10/384,420

(22) Filed: Mar. 7, 2003

(51) Int. Cl.[7] ..... G09F 17/00
(52) U.S. Cl. ..... 116/174
(58) Field of Search ..... 116/173, 174, 116/28 R; 73/170.01, 170.02, 170.03, 170.05, 170.07, 170.11, 170.15; 473/176, 177; 40/412, 413; D11/165, 166

(56) References Cited

U.S. PATENT DOCUMENTS

| | | | | | |
|---|---|---|---|---|---|
| 1,002,260 | A | * | 9/1911 | Golden | 246/477 |
| 1,134,002 | A | * | 3/1915 | Olstad | 116/173 |
| 1,273,098 | A | * | 7/1918 | Schumann | 116/173 |
| 1,311,712 | A | * | 7/1919 | Power | 116/174 |
| 1,753,506 | A | * | 4/1930 | Florine | 248/145 |
| 2,799,240 | A | * | 7/1957 | Andrews | 116/174 |
| 2,853,046 | A | * | 9/1958 | Meade | 116/173 |
| 3,706,297 | A | | 12/1972 | Voorhees | |
| 3,715,821 | A | * | 2/1973 | Hawes | 40/591 |
| 3,762,360 | A | * | 10/1973 | Hawes | 116/28 R |
| 4,144,833 | A | * | 3/1979 | Newman, Sr. | 116/28 R |
| 4,554,885 | A | * | 11/1985 | Burny, Jr. | 116/174 |
| 4,850,798 | A | * | 7/1989 | Bailey | 416/11 |
| 5,070,809 | A | | 12/1991 | Fox et al. | 716/174 |
| 5,117,690 | A | * | 6/1992 | Baer | 73/170.07 |
| 5,335,621 | A | * | 8/1994 | Willis et al. | 116/173 |
| 5,375,801 | A | * | 12/1994 | Porter | 248/156 |
| 5,412,982 | A | | 5/1995 | Potts | 73/170.05 |
| 5,495,821 | A | | 3/1996 | Brewer | 116/174 |
| 5,509,371 | A | | 4/1996 | Phillips | |
| 5,522,342 | A | | 6/1996 | Chen-Chao | |
| 5,701,840 | A | | 12/1997 | Cross | |
| 5,809,930 | A | * | 9/1998 | Brooks | 116/174 |
| 5,884,578 | A | * | 3/1999 | Thostrup et al. | 116/174 |
| 6,155,018 | A | | 12/2000 | Yang | |
| 6,276,083 | B1 | * | 8/2001 | Ross | 40/606.15 |

FOREIGN PATENT DOCUMENTS

| | | | | |
|---|---|---|---|---|
| JP | 2002244602 | A | * 8/2002 | G09F/17/00 |

* cited by examiner

*Primary Examiner*—Diego Gutierrez
*Assistant Examiner*—R. Alexander Smith

(57) ABSTRACT

An anti-fouling flag and windsock display assembly for displaying a flag or windsock without it wrapping around the display assembly due to wind includes a pole having a hollow top portion, a swivel attachment insertable into the hollow top portion, and an attachment rod extending from the swivel assembly. For a flag, one end of an anchoring line is attached to a bottom corner of the flag and a second looped end is attached to freely rotate around the pole.

18 Claims, 6 Drawing Sheets

ANTI-FOULING FLAG AND WINDSOCK DISPLAY ASSEMBLY

BACKGROUND OF THE INVENTION

1. Field of the Invention

The present invention relates to flag display devices and more particularly pertains to a new anti-fouling flag and windsock display assembly for displaying a flag or windsock without it wrapping around the display assembly due to wind.

2. Description of the Prior Art

The use of flag display devices is known in the prior art. U.S. Pat. No. 5,495,821 describes a device utilizing flexible connectors attached in close proximity to a pole. Another type of display device is U.S. Pat. No. 5,412,982 having a rotating arm attached to a single bushing in a cup member to be fit over a pole. U.S. Pat. No. 5,070,809 discloses a banner display device that includes a rotating top for holding a vertically oriented banner in close proximity to the device such that the banner is constantly held in an unfurled position. Other examples of display devices that hold a flag in a typical fashion close to a pole include U.S. Pat. No. 5,522,342; U.S. Pat. No. 3,706,297; U.S. Pat. No. 5,701,840; U.S. Pat. No. 5,509,371; U.S. Pat. No. 5,509,371; and U.S. Pat. No. 6,155,018.

While these devices fulfill their respective, particular objectives and requirements, the need remains for a device that permits a flag or windsock to move around a pole in sufficiently spaced relationship to further prohibit entanglement of the flag or windsock with the pole or flag display device.

SUMMARY OF THE INVENTION

The present invention meets the needs presented above by providing swiveling attachment to a pole in sufficiently spaced relationship to prohibit entanglement.

Another object of the present invention is to provide a new anti-fouling flag and windsock display assembly that is easily assembled and durable.

Still another object of the present invention is to provide a new anti-fouling flag and windsock display assembly that is weather and corrosion resistant.

Yet another object of the present invention is to provide a flag and windsock holding device that spins freely to provide an indication of wind speed and direction.

To this end, the present invention generally comprises a pole having a hollow top portion, a swivel attachment insertable into the hollow top portion, and an attachment rod extending from the swivel assembly. For a-flag, one end of an anchoring line is attached to a bottom corner of the flag and a second looped end is attached to freely rotate around the pole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
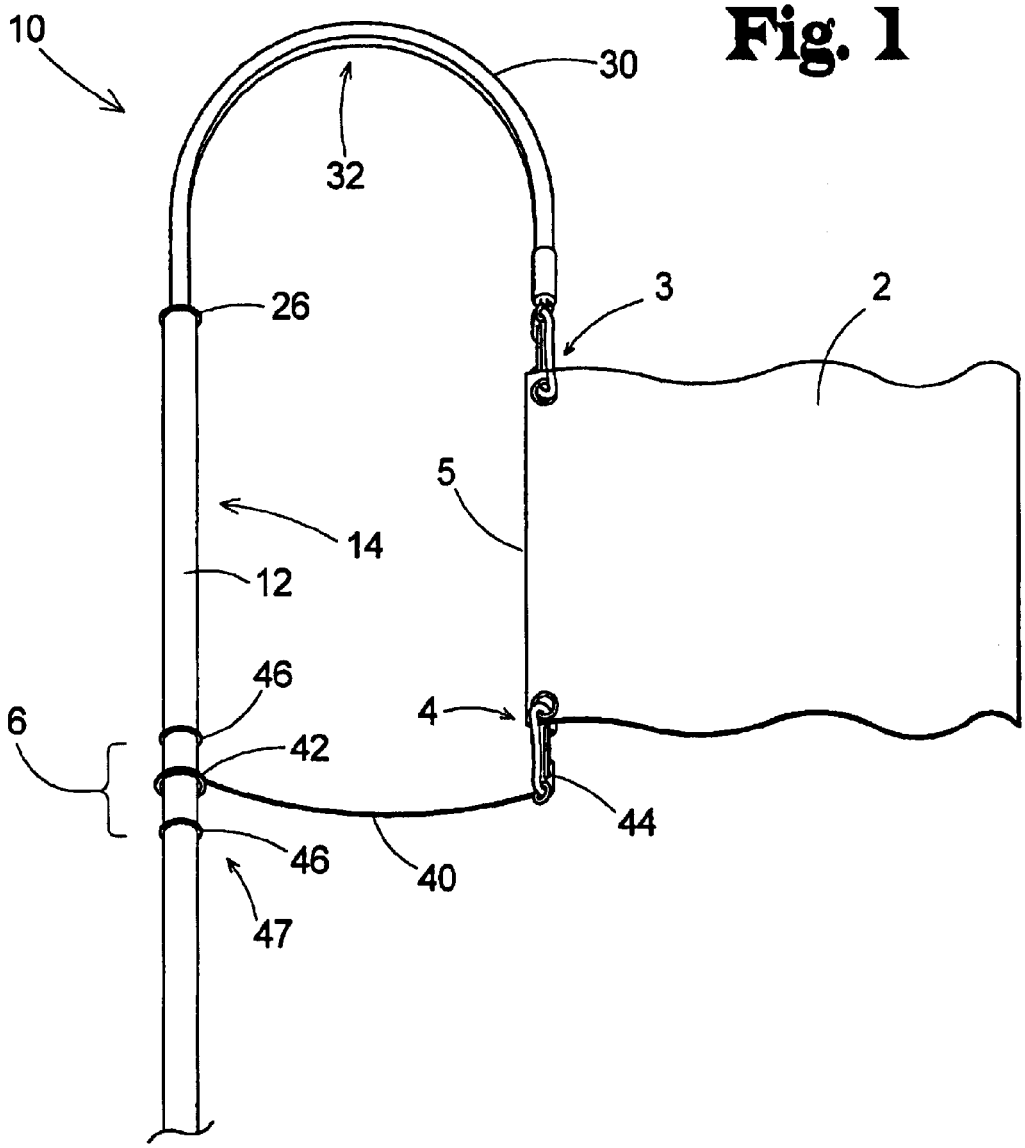
FIG. 1 is a side view of a new anti-fouling flag and windsock display assembly according to the present invention.
Figure 2:
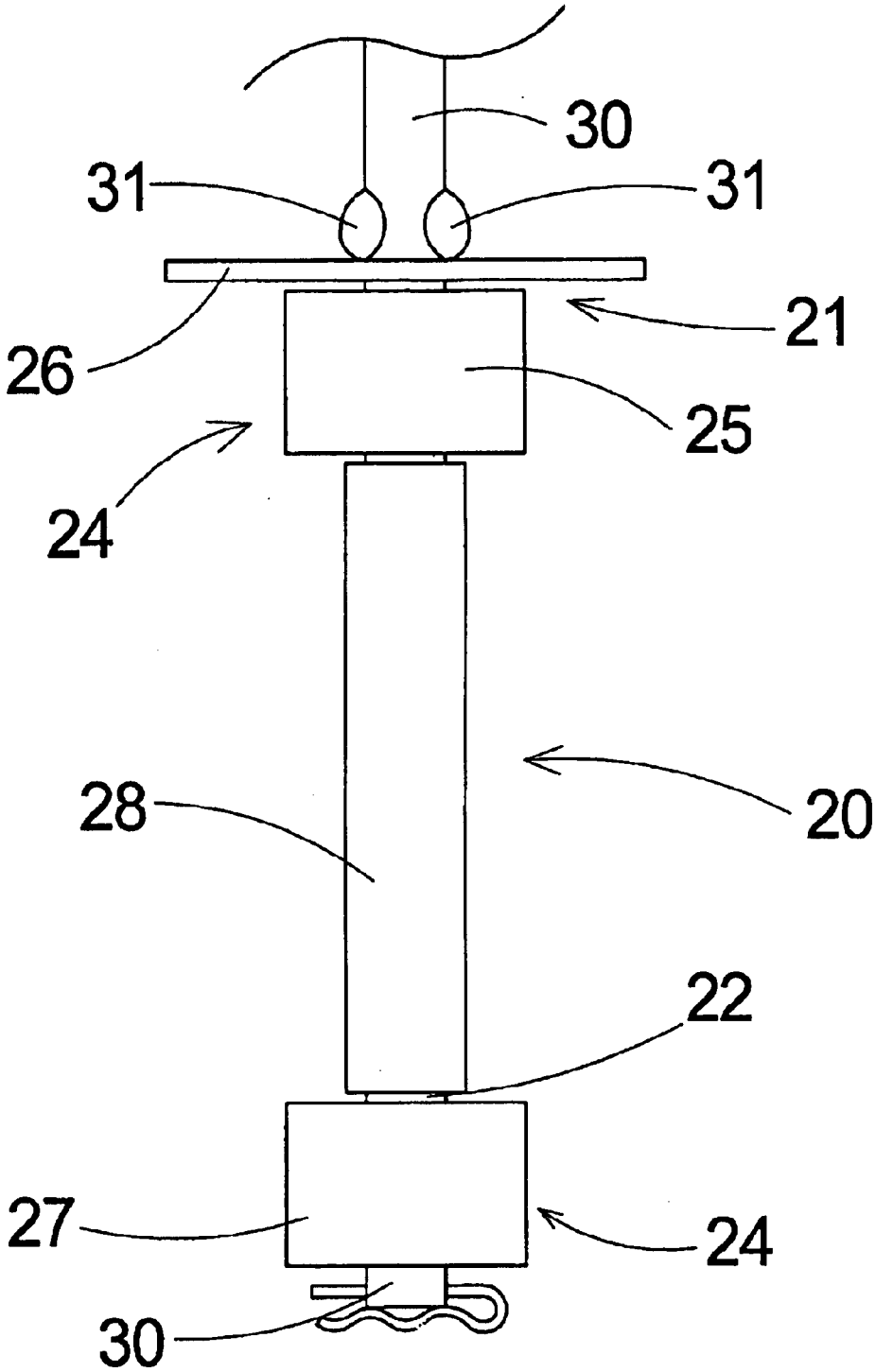
FIG. 2 is a side view of the swivel assembly of the present invention.
Figure 3:
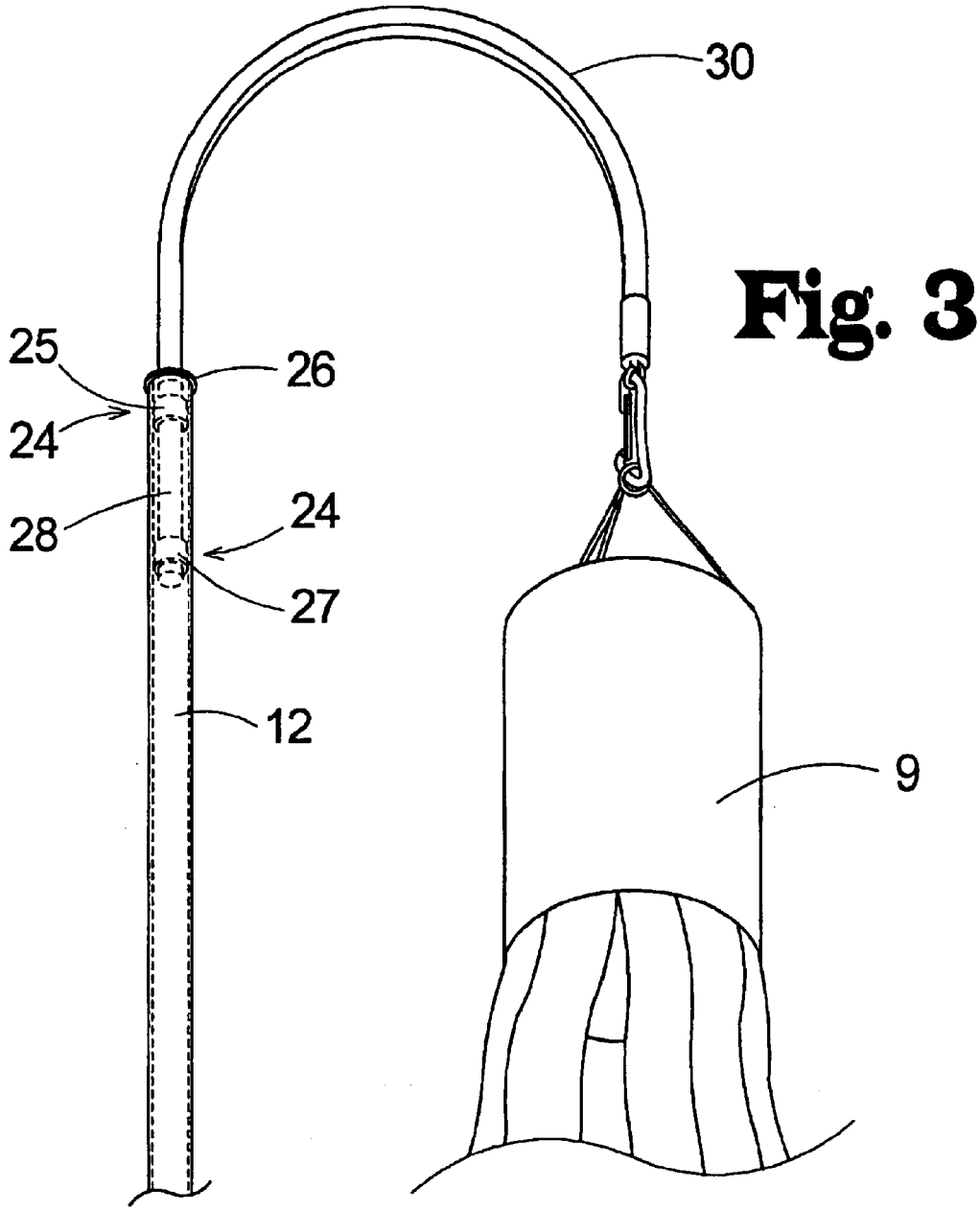
FIG. 3 is a partial cut away side view of the present invention.
Figure 4:
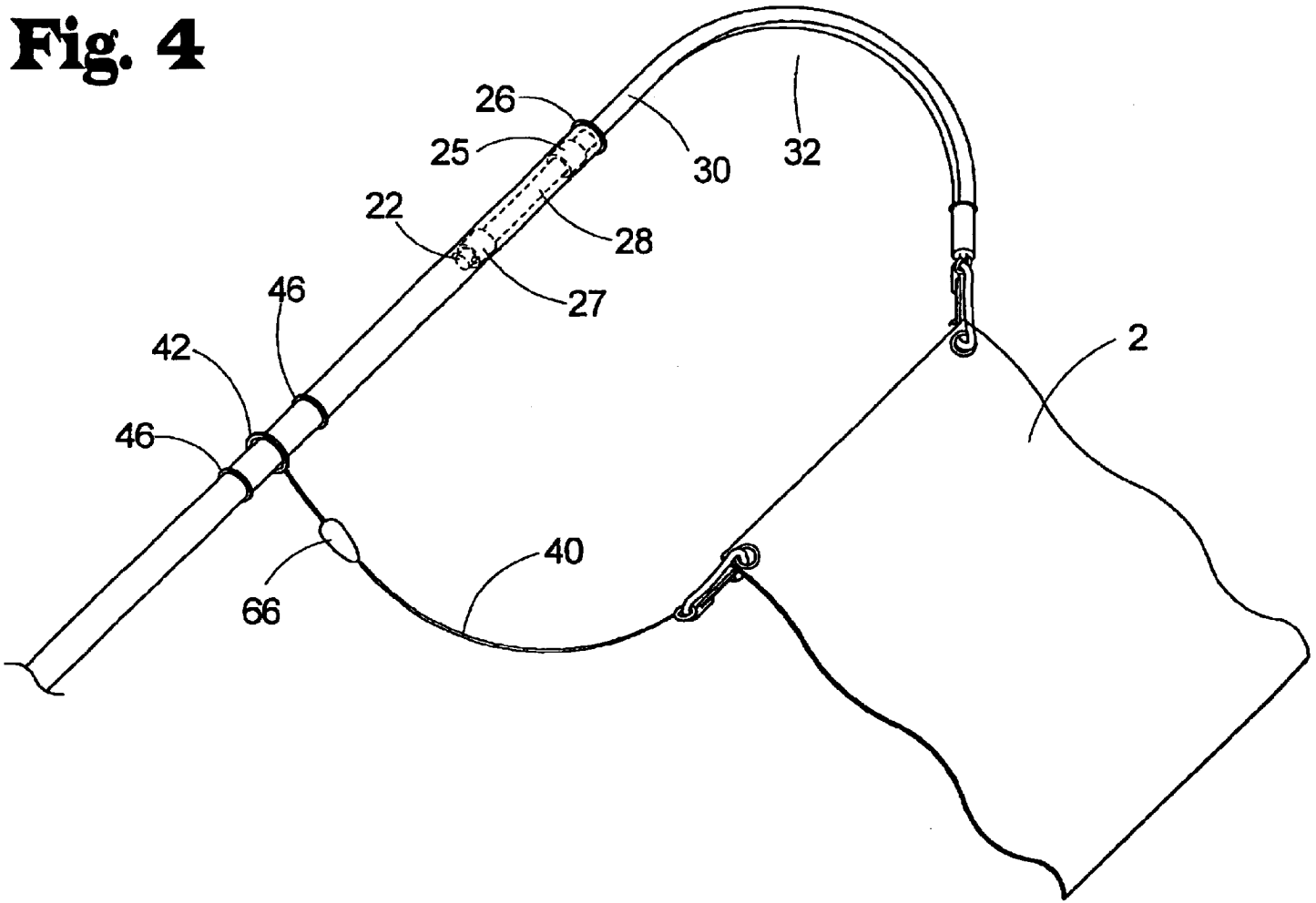
FIG. 4 is a side view of an embodiment of the present invention.

With reference now to the drawings, and in particular to FIGS. 1 through 5 thereof, a new anti-fouling flag and windsock display assembly embodying the principles and concepts of the present invention and generally designated by the reference numeral will be described.

As best illustrated in FIGS. 1 through 5, the anti-fouling flag and windsock display assembly 10 generally comprises a pole 12 having a hollow top portion 14, a swivel assembly 20 insertable into the hollow top portion 14, and an attachment rod 30 coupled to and extending from the swivel assembly 20 such that the attachment rod 30 is free to swivel relative to the pole 12. The hollow top portion 14 may be in either a hollow pole or a pole having solid and hollow sections so long as the top portion of the pole is hollow along a sufficient length to receive the swivel assembly 20.

In an embodiment designed particularly for holding a flag in a traditional orientation, the attachment rod 30 is coupled to a flag 2 near a top corner 3 of the flag 2. The attachment rod 30 includes an arcuate portion 32. An anchoring line 40 is provided having a loop end 42 and a connection end 44. The connection end 44 is designed for coupling to a bottom portion 4 of the flag 2. The pole 12 is insertable through the loop end 42 such that the anchoring line 40 is free to move around the pole 12. The anchoring line 40 has a length such that an edge 5 of the flag 2 is held in a substantially vertical position and wind will unfurl the flag outwardly from the pole 12.

A pair of retainer members 46 are coupled to the pole 12. The retainer members 46 are spaced on the pole 12. The loop end 42 of the anchor line 40 is positioned between the retainer members 46 such that the loop end 42 is retained in a space 6 along the pole 12 between the pair of retainer members 46. Each of the retainer members 46 may be a resilient band 47 frictionally engaged to the pole 12. Each retaining member 47 preferably has a generally rectangular cross-section for preventing the retaining member 47 from rolling out of position on the pole 12.

In an alternate embodiment for displaying the flag 2 in a hanging orientation, the attachment rod 30 includes a straight portion 33. When the swivel assembly 20 is inserted into the pole 12, the straight portion 33 extends orthogonally from the pole 12. Thus, the attachment rod 30 is designed for supporting two upper corners of the flag in a horizontal orientation such that the flag 2 hangs from the straight portion 33.

The swivel assembly 20 includes an axle portion 22 extending from the attachment rod 30. A pair of bearing members 24 are coupled to the axle portion 22. A support member 26 is coupled to the attachment rod 30. The support member 26 extends outwardly from a proximal end 21 of the axle portion 22. The attachment rod 30 includes a pair of swaged ears 31 for abutting the support member 26 to hold the attachment rod 30 above the support member 26. The support member 26 has a diameter greater than a diameter of the pole 12 for supporting the swivel assembly 20 when the swivel assembly 20 is inserted into the hollow portion 14 of the pole 12.

The pair of bearing members 24 includes a proximal bearing 25 and a distal bearing 27. The proximal bearing 25 is positioned adjacent the support member 26. The distal bearing 27 is positioned proximate a distal end of the axle portion 22.

In an embodiment, the bearing members are free to spin around the axle portion 22. A spacer 28 is coupled to the axle portion 22 and positioned between the bearing members 24 for holding the bearing members 24 in a spaced relationship.

When the pole 12 is positioned in a-substantially vertical orientation, it is preferred that the arcuate portion 32 of the attachment rod 30 be substantially semi-circular. When the pole 12 is positioned at a substantially 45 degree angle from vertical, it is preferred that the arcuate portion 32 of the attachment rod 30 forms a quarter circle and the anchoring line 40 is of sufficient length to hold an edge of the flag in a substantially parallel position to the pole.

Figure 5:
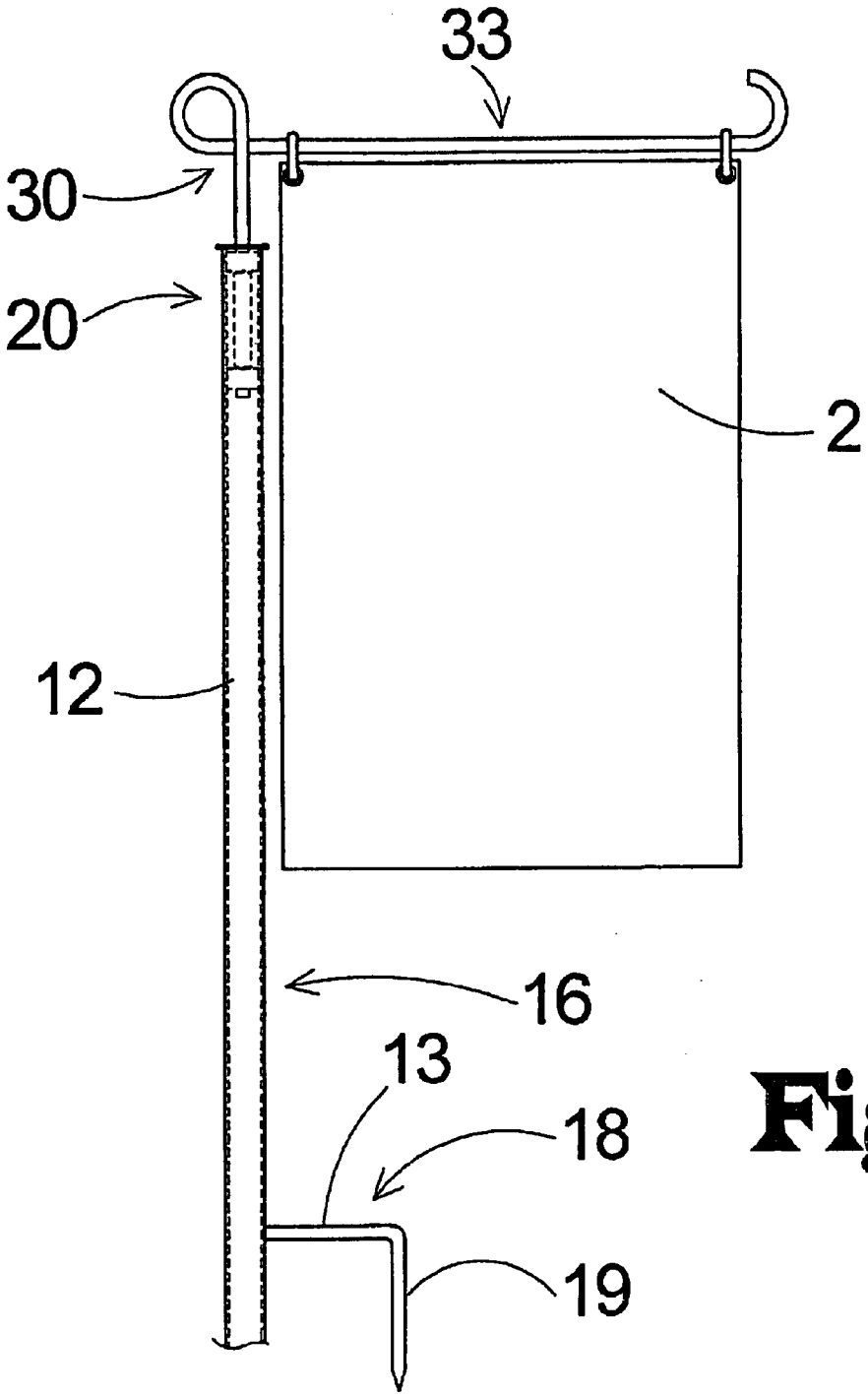
FIG. 5 is a side view of an embodiment of the present invention.

As shown in FIG. 5, the pole 12 may include a main portion 16 and an optional inverted L-shaped extension portion 18. A distal flange 19 of the extension portion 18 is positioned parallel to the main portion 16 and aligned with a bottom portion 15 of the main portion 16. Thus, the pole 12 is designed for being inserted into a ground surface such that the extension portion 18 prevents twisting of the main portion 16. A proximal flange 13 of the optional extension portion 18 also forms an area convenient for stepping upon to assist in inserting the pole into the ground.

Figure 6:
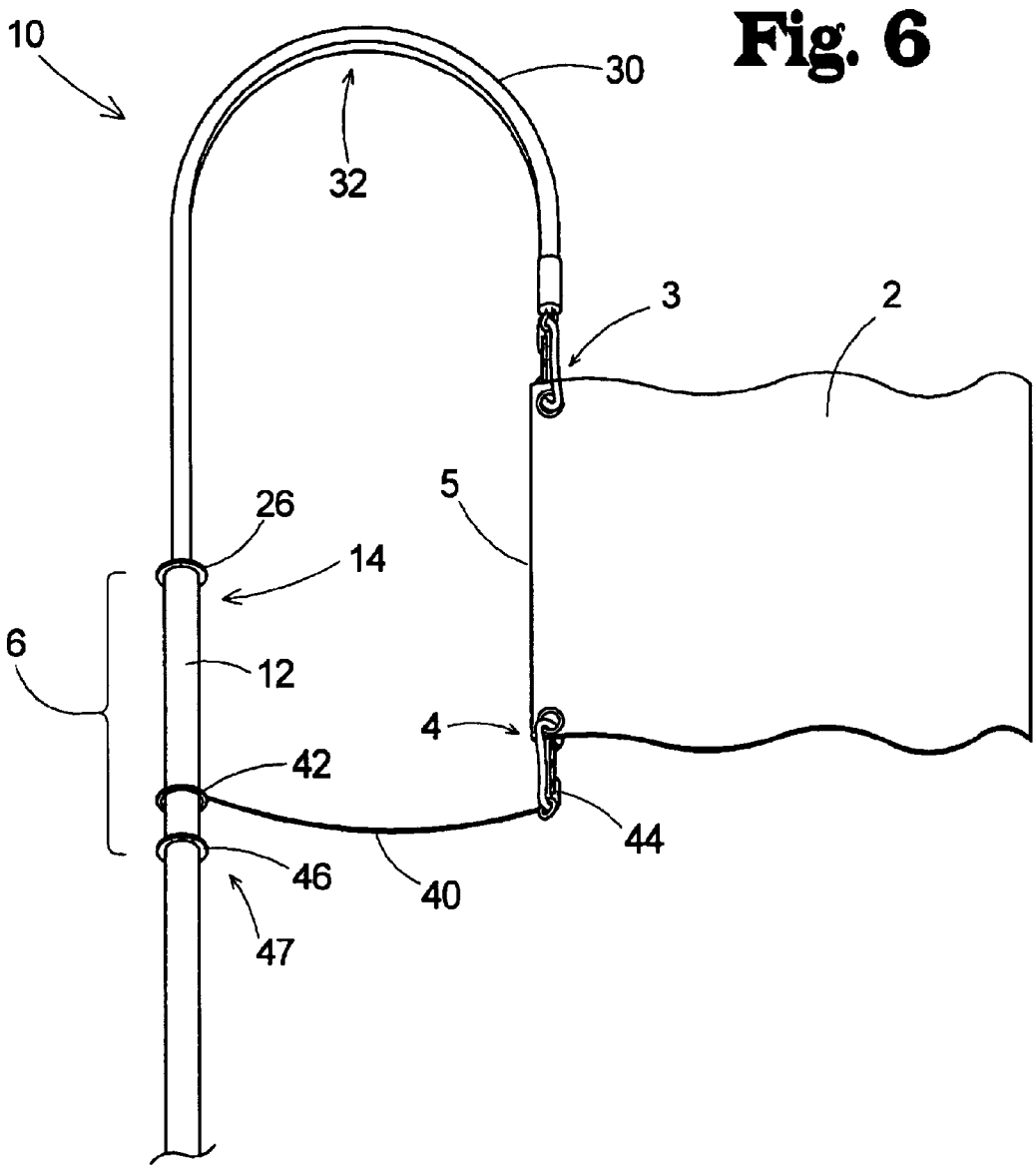
FIG. 6 is a side view of an embodiment of the present invention.

In an embodiment FIG. 6, the support member 26 has a diameter greater than a diameter of the loop end 42 of the anchor line 40 for preventing the loop end 42 from sliding off of the pole 12 where the loop end 42 may become sufficiently tangled to prevent free movement which may in turn result in tangling of the flag 2. In this embodiment, a single retainer member 46 is required. The single retainer member 46 is spaced on the pole 12 from the support member 26. The loop end 42 of the anchor line 40 is positioned between the retainer member 46 and the support member 26 such that the loop end 42 is retained in a space along the pole 12 between the retainer member 46 and the support member 26.

The anchor line 40 may be formed by interconnecting components including a swivel connector 66 for preventing twisting of the anchor line 40 during use. The loop end 42 may be formed by a split ring of the type commonly used for holding keys.

In use, the pole is positioned as desired and the swivel assembly is inserted into the pole to rest on the pole. A windsock 9 may be attached to the attachment rod so that it is permitted to move freely about the pole as the wind dictates. When a flag is being displayed, the anchoring line is attached to the pole by inserting the pole through the loop end, typically prior to insertion of the swivel attachment. The loop end is positioned between the support member and a single retainer member, or preferably between two retainer members, to restrict the loop end to a desired space on the pole. The flag is attached to the end of the attachment rod and to the free end of the attachment line.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An anti-fouling flag and windsock display assembly comprising:

a pole having a hollow top portion;

a swivel assembly inserted into said hollow top portion;

an attachment rod coupled to and extending from said swivel assembly such that said attachment rod is free to swivel relative to said pole, said attachment rod being for coupling to a portion of a flag;

an anchoring line having a loop end and a connection end, said connection end being adapted for coupling to a bottom portion of a flag, said pole being inserted through said loop end such that said anchoring line is free to move around said pole; and a pair of retainer members coupled to said pole, said retainer members being spaced on said pole, said loop end of said anchor line being positioned between said retainer members such that said loop end is retained by said retainer members in a space along said pole between said pair of retainer members.

2. The anti-fouling flag and windsock display assembly of claim 1 wherein said attachment rod includes an arcuate portion; and said anchoring line having a length such that an edge of the flag is held in a substantially parallel position to said pole.

3. The anti-fouling flag and windsock display assembly of claim 2 wherein said pole is positioned in a substantially vertical orientation; and said arcuate portion of said attachment rod being substantially semi-circular.

4. The anti-fouling flag and windsock display assembly of claim 2 wherein said pole is positioned at a substantially 45 degree angle from vertical; and said arcuate portion of said attachment rod forming a quarter circle.

5. The anti-fouling flag and windsock display assembly of claim 1 wherein each of said retainer members is a resilient band frictionally engaged to said pole, each said retaining member having a generally rectangular cross-section for preventing said retaining member from rolling out of position on said pole.

6. The anti-fouling flag and windsock display assembly of claim 1 wherein said swivel assembly comprises:

said rod including an axle portion;

a pair of bearing members coupled to said axle portion; and a support member coupled to said attachment rod, said support member extending outwardly from a proximal end of said axle portion, said support member having a diameter greater than a diameter of said pole for supporting said swivel assembly when said axle portion is inserted into said hollow portion of said pole.

7. The anti-fouling flag and windsock display assembly of claim 6, further comprising:

said pair of bearing members including a proximal bearing and a distal bearing, said proximal bearing being positioned adjacent said support member, said distal bearing being positioned proximate a distal end of said axle portion.

8. The anti-fouling flag and windsock display assembly of claim 6, further comprising:

a spacer coupled to said axle portion and positioned between said bearing members for holding said bearing members in a spaced relationship.

9. The anti-fouling flag and windsock display assembly of claim 6 wherein said support member has a diameter greater than a diameter of said loop end of said anchor line for preventing said loop end from sliding off of said pole.

10. The anti-fouling flag and windsock display assembly of claim 1, further comprising:

said pole including a main portion and an inverted L-shaped extension portion, a distal flange of said extension portion being positioned parallel to said main portion and aligned with a bottom portion of said main portion whereby said pole is adapted for being inserted into a ground surface such that said extension portion prevents twisting of said main portion.

11. The anti-fouling flag and windsock display assembly of claim 6 wherein said attachment rod includes a pair of swaged cars for abutting said support member to hold said attachment rod above said support member.

12. The anti-fouling flag and windsock display assembly of claim 1 wherein said anchor line includes a swivel connector for preventing twisting of said anchor line during use.

13. An anti-fouling flag and windsock display assembly comprising:

a pole having a hollow top portion;

a swivel assembly inserted into said hollow top portion;

an attachment rod coupled to and extending from said swivel assembly such that said attachment rod is free to swivel relative to said pole, said attachment rod being for coupling to a portion of a flag;

an anchoring line having a loop end and a connection end, said connection end being adapted for coupling to a bottom portion of a flag, said pole being inserted through said loop end such that said anchoring line is free to move around said pole;

wherein said swivel assembly further comprises said rod including an axle portion, a pair of bearing members coupled to said axle portion, a support member coupled to said attachment rod, said support member extending outwardly from a proximal end of said axle portion, wherein said support member has a diameter greater than a diameter of said loop end of said anchor line for preventing said loop end from sliding off of said pole; and a retainer member coupled to said pole, said retainer member being spaced on said pole from said support member, said loop end of said anchor line being positioned between said retainer member and said support member such that said loop end is retained by said retainer member and said support member in a space along said pole between said retainer member and said support member.

14. The anti-fouling flag and windsock display assembly of claim 13 wherein said attachment rod includes an arcuate portion; and said anchoring line having a length such that an edge of the flag is held in a substantially parallel position to said pole.

15. The anti-fouling flag and windsock display assembly of claim 13, wherein said retainer member is a resilient band frictionally engaged to said pole, said retaining member having a generally rectangular cross-section for preventing said retaining member from rolling out of position on said pole.

16. The anti-fouling flag and windsock display assembly of claim 13, further comprising:

a spacer coupled to said axle portion and positioned between said bearing members for holding said bearing members in a spaced relationship.

17. The anti-fouling flag and windsock display assembly of claim 13, further comprising:

said pole including a main portion and an inverted L-shaped extension portion, a distal flange of said extension portion being positioned parallel to said main portion and aligned with a bottom portion of said main portion whereby said pole is adapted for being inserted into a-ground surface such that said extension portion prevents twisting of said main portion.

18. The anti-fouling flag and windsock display assembly of claim 13, wherein said anchor line includes a swivel connector for preventing twisting of said anchor line during use.

* * * * *